United States Patent [19]

Huvar

[11] 4,349,392

[45] Sep. 14, 1982

[54] TRIVALENT CHROMIUM PASSIVATE SOLUTION AND PROCESS

[75] Inventor: Robert J. Huvar, Ann Arbor, Mich.

[73] Assignee: Occidental Chemical Corporation, Warren, Mich.

[21] Appl. No.: 265,487

[22] Filed: May 20, 1981

[51] Int. Cl.[3] ..... C23F 7/26

[52] U.S. Cl. ..... 148/6.2; 148/6.21

[58] Field of Search ..... 148/6.2, 6.21

[56] References Cited

U.S. PATENT DOCUMENTS 3,501,352 3/1970 Shah ..... 148/6.2

3,932,198 1/1976 Schneider ..... 148/6.2

*Primary Examiner*—Ralph S. Kendall

*Attorney, Agent, or Firm*—Richard P. Mueller; Arthur E. Kluegel

[57] ABSTRACT

An aqueous acidic solution and process for treating metal surfaces, particularly zinc and zinc alloy surfaces, for depositing a passivate film of improved clarity and hardness and to impart improved corrosion resistance thereto. The solution contains effective amounts of chromium ions substantially all of which are in the trivalent state, hydrogen ions to provide a pH of about 1.2 to about 2.5, an oxidizing agent, a bath soluble and compatible organic carboxylic acid or metal salts thereof present in an amount to impart increased initial hardness and improved clarity to the passivate film and at least one additional metal ion selected from the group consisting of iron, cobalt, nickel, molybdenum, manganese, lanthanum, cerium, lanthanide mixtures as well as mixtures thereof. The treating solution may optionally further contain halide ions and a wetting agent.

42 Claims, No Drawings

TRIVALENT CHROMIUM PASSIVATE SOLUTION AND PROCESS

BACKGROUND OF THE INVENTION

A variety of chromium containing aqueous solutions have heretofore been used or proposed for treating zinc, zinc alloy, cadmium and cadmium alloy surfaces for improving the corrosion resistance properties thereof and to further enhance the appearance of such surfaces by imparting a yellow or a blue-bright coating thereto, the latter simulating a chromium finish. Such treating solutions originally contained chromium in the hexavalent state and in more recent years the chromium constituent was present as a mixture of the hexavalent and trivalent forms. The reduced toxicity of trivalent chromium and the increased simplicity and efficiency in treating waste effluents containing trivalent chromium has occasioned an increased commercial use of treating solutions in which the chromium constituent is substantially entirely in the trivalent state. Such prior art trivalent chromium passivating solutions have been found to be somewhat less effective than the hexavalent chromium passivate solutions in imparting good corrosion resistance to the zinc, zinc alloy, cadmium and cadmium alloy surfaces treated and there has, accordingly, been a continuing need for further improvement in trivalent chromium passivate solutions and processes.

The foregoing problem has been further aggravated by a conversion from conventional cyanide zinc and cadmium plating processes to acid and alkaline non-cyanide electroplating baths which produce metal deposits which are not as receptive to chromium passivate treatments.

Typical of prior art compositions and processes for treating zinc and zinc alloy surfaces are those disclosed in U.S. Pat. Nos. 2,393,663; 2,559,878; 3,090,710; 3,553,034; 3,755,018; 3,795,549; 3,880,772; 3,932,198; 4,126,490; 4,171,231; British Pat. Nos. 586,517 and 1,461,244; and German Pat. No. 2,526,832.

While improvements have been made in trivalent chromium passivate compositions and processes to produce commercially acceptable passivate films, such films as initially formed have been found in some instances to lack sufficient initial hardness to enable handling of the substrate through further work stages without encountering damage to passivate film. Additionally, such trivalent chromium passivate compositions and processes have also been found in some instances to produce films which are somewhat cloudy and lack optimum clarity from an appearance standpoint.

The present invention provides a treating solution and process which is effective to impart improved corrosion resistance to zinc, zinc alloy, cadmium and cadmium alloy, as well as aluminum and magnesium surfaces and to impart a desirable surface finish which can range from a clear bright to a light blue-bright to a yellow iridescent appearance, which produces a passivate film of improved clarity and initial hardness, which process is simple to control and operate and which is of efficient and economical operation.

SUMMARY OF THE INVENTION

The benefits and advantages of the present invention are achieved in accordance with the composition aspects thereof by providing an aqueous acidic treating solution containing as its essential constituents, chromium ions substantially all of which are present in the trivalent state at a concentration of from about 0.05 grams per liter (g/l) up to saturation, hydrogen ions to provide a solution pH of about 1.2 to about 2.5 which can be conveniently introduced by mineral acids such as sulfuric acid, nitric acid, hydrochloric acid or the like, an oxidizing agent of which hydrogen peroxide itself is preferred present in an amount of about 1 to about 20 g/l, a bath soluble and compatible organic carboxylic acid present in an amount effective to impart initial hardness and clarity to the passivate film of the structural formula:

$$(OH)_aR(COOH)_b$$

wherein:

a is an integer from 0 to 6;

b is an integer from 1 to 3; and

R is an alkyl, alkenyl, or aryl contaning from $C_1$ to $C_6$ carbon atoms;

as well as the bath soluble and compatible salts thereof;

at least one additional metal ion selected from the group consisting of iron, cobalt, nickel, molybdenum, manganese, lanthanum, cerium and lanthanide mixtures, as well as mixtures thereof present in an amount effective to activate the bath and formation of a chromium passivate film of the desired appearance on the substrate treated. The solution may further optionally contain halide ions for imparting additional hardness to the coating as well as a wetting agent.

In accordance with the process aspects of the present invention, zinc, cadmium or zinc alloy or cadmium alloy surfaces are contacted with the aqueous acidic treating solution preferably at a temperature ranging from about 40° to about 150° F., preferably from about 70° to about 90° F. for a period of time typically ranging from about 10 seconds to about one minute to form the desired passivate coating thereon.

Additional benefits and advantages will become apparent on a reading of the Description of the Preferred Embodiments taken in conjunction with the examples provided.

DESCRIPTION OF THE PREFERRED EMBODIMENTS

The present invention is particularly applicable but not limited to the treatment of alkaline and acidic non-cyanide zinc electrodeposits to impart improved corrosion resistance and a decorative appearance to the treated substrate. Particularly satisfactory results are obtained on decorative zinc electrodeposits of the bright and semi-bright types although beneficial effects are also achieved on zinc and zinc alloy substrates such as galvanized substrates, zinc die castings and substrates comprised of cadmium or alloys of cadmium predominantly comprised of cadmium. While the invention as herein described is particularly directed to the treatment of zinc and zinc alloy surfaces, it has been observed that beneficial results are also obtained in the treatment of aluminum, aluminum alloy, magnesium and magnesium alloy surfaces to form a passivate film or coating thereon. Accordingly, the present invention in its broad sense is directed to the treatment of metal surfaces which are receptive to the formation of a passivate film thereon when contacted with the solution of the present invention in accordance with the process parameters disclosed.

In the case of decorative zinc electroplatings, a further enhancement of the appearance of such substrates in addition to the corrosion resistance imparted is achieved by the passivate film which ranges from a clear bright to a light blue bright appearance simulating that of a chromium deposit or alternatively, a clear light-yellow appearance simulating that obtained by use of prior art hexavalent chromium solutions.

In accordance with the present invention, the treating solution contains as its essential constituents, chromium ions which are present substantially all of the trivalent state, hydrogen ions to provide a pH of from about 1.2 to about 2.5, an oxidizing agent in an amount effective to activate the hydrated trivalent chromium to form a chromate film on the metal surface, a bath soluble and compatible organic carboxylic acid present in an amount effective to impart initial hardness and clarity to the passivate film of the structural formula:

$$(OH)_aR(COOH)_b$$

wherein:

a is an integer from 0 to 6;

b is an integer from 1 to 3; and

R is an alkyl, alkenyl, or aryl containing from $C_1$ to $C_6$ carbon atoms;

as well as the bath soluble and compatible salts thereof;

at least one additional metal ion selected from the group consisting of iron, cobalt, nickel, molybdenum, manganese, lanthanum, cerium and lanthanide mixtures of rare earth metals as well as mixtures thereof present in an amount effective to impart integral hardness to the gelatinous chromate film. The treating solution may optionally further contain halide ions including fluoride, chloride and bromide ions for further increasing the hardness of the passivate film as well as one or more compatible wetting agents for achieving efficient contact with the substrate being treated.

The trivalent chromium ions can be introduced in the form of any bath soluble and compatible salt such as chromium sulfate [$Cr_2(SO_4)_2$], chromium alum [$KCr(SO_4)_2$], chromium chloride [$CrCl_3$], chromium bromide [$CrBr_3$], chromium fluoride [$CrF_3$], chromium nitrate [$CrNO_3$], or the like. The trivalent chromium ions can also be introduced by a reduction of a solution containing hexavalent chromium ions employing an appropriate reducing agent of any of the types well known in the art to effect a substantially complete stoichiometric reduction of all of the hexavalent chromium to the trivalent state.

The concentration of the trivalent chromium ions in the treating solution may range from as low as about 0.05 g/l up to saturation with quantities of about 0.2 to 2 g/l being preferred. Typically, the operating bath contains from about 0.5 to about 1 g/l trivalent chromium ions.

The treating bath contains hydrogen ions in an amount to provide a pH of about 1.2 to about 2.5 with a pH range of about 1.6 to about 1.8 being preferred for producing clear to light-blue passivate films and a pH of about 1.5 to about 2.0 for yellow passivate films. Acidification of the operating bath to within the desired pH range can be achieved by a variety of mineral acids and organic acids such as sulfuric acid, nitric acid, hydrochloric acid, formic acid, acetic acid, propionic acid and the like of which sulfuric acid and nitric acid are preferred. The presence of sulfate ions in the bath has been found beneficial in achieving the desired passivation of the substrate and can be introduced by the sulfuric acid addition or sulfate salts of the other bath constituents. Sulfate ion concentrations can range in amounts up to about 15 g/l with amounts of about 0.5 to about 5 g/l being preferred.

The treating bath further contains an oxidizing agent or agents which are bath compatible of which peroxides including hydrogen peroxide and metal peroxides such as the alkali metal peroxides are preferred. Hydrogen peroxide itself of a commercial grade containing about 25% to about 60% by volume peroxide constitutes the preferred material. Other peroxides that can be employed include zinc peroxide. Additionally, ammonium and alkali metal persulfates have also been found effective as oxidizing agents.

The concentration of the oxidizing agent or mixture of oxidizing agents is controlled to achieve the desired surface appearance of the treated substrate. Typically, the concentration of the oxidizing agent can range from about 1 to about 20 g/l with an amount of about 3 to about 7 g/l being preferred calculated on a weight equivalent effectiveness basis to hydrogen peroxide.

In addition, the bath further contains at least one additional metal ion selected from the group consisting of iron, cobalt, nickel, molybdenum, manganese, lanthanum, cerium, lanthanide mixtures as well as mixtures thereof. The foregoing metal ions or mixtures of metal ions are conveniently introduced into the bath by way of bath soluble and compatible metal salts including the sulfates, nitrates, halide salts, or the like. For economic reasons, the lanthanum ions are introduced not as a pure lanthanum compound, but as a mixture of the rare earth salts of the metals of the lanthanide series, (hereinafter designated as "lanthanide mixture") which contains lanthanum compounds as the predominant constituent. A commercially available lanthanide mixture which is suitable for use in the practice of the present invention is Lanthanum—Rare Earth Chloride, product code 5240, available from Molycorp, Inc. of White Plains, N.Y. This product has the general formula La—$RECl_3.6H_2O$ and is available as a solution containing about 55 to 60% by weight solids. The solution is prepared from a rare earth oxide (REO) concentrate containing a minimum of 46% by weight total REO comprising about 60% lanthanum oxide ($La_2O_3$), 21.5% neodymium oxide ($Nd_2O_3$), 10% cerium oxide ($CeO_2$), 7.5% praseodymium oxide ($Pr_6O_{11}$) and 1% of residual REO. The presence of such other rare earth metals in the solution does not appear to have any adverse effect at the low concentrations in which they are present and may further contribute to the activation of the treating solution in forming the passivate film.

The foregoing metal ions or combinations thereof with the exception of cerium ions are employed for producing a clear to a light-blue passivate film. When a light-yellow iridescent passivate film is desired, cerium ions are employed, preferably in combination with one or more of the other metal ions to produce a passivate film simulating in appearance the light yellow passivate films heretofore obtained employing hexavalent chromium passivating solutions which have been recognized and embodied in ASTM specifications in view of their characteristic color and associated excellent corrosion resistance. The cerium ions can be introduced in the form of any bath soluble and compatible cerium salt including cerium sulfate [$Ce(SO_4)_2 \cdot 4H_2O$]; halide salts such as cerous chloride [$CaCl_3 \cdot 6H_2O$]; nitrate salts such as cerium nitrate [$Ce(NO_3)\cdot 5H_2O$], [$Ce(NO_3)_3(OH)\cdot 3H_2O$] and the like.

Usually, at least some of the cerium ions are introduced into the bath in the tetravalent state to impart the characteristic yellow color of the tetravalent cerium ion into the passivate film. Certain oxidizing agents such as hydrogen peroxide, act as a reducing agent under the acid conditions prevalent in the bulk of the operating bath and reduce some of the tetravelent cerium ions to the trivalent state. However, oxidizing agents such as hydrogen peroxide revert from a reducing agent to an oxidizing agent at the interface of the substrate being treated due to the higher pH prevalent at the interface and oxidize at least some of the trivalent cerium ions to the tetravalent state which are deposited in the film and impart the characteristic yellow color thereto. When using such oxidizing agents as hydrogen peroxide, accordingly, all of the cerium ions can, if desired, be initially introduced into the operating bath in the trivalent state of which a portion are oxidized to the tetravalent state at the interface of the substrate. The passivate film usually contains a mixture of trivalent and tetravalent cerium compounds and the intensity of the yellow color of the film is dictated by the concentration of tetravalent cerium compounds present. The cerium sulfate compound, due to solubility difficulties, is preferably added to the bath in the form of an acid solution such as a sulfuric acid solution containing the cerium sulfate dissolved therein.

The concentration of cerium ions in the operating bath can range from about 0.5 up to about 10 g/l with concentrations of from about 1.0 to about 4.0 g/l being preferred. The concentration of cerium ions is in part influenced by the magnitude of the yellow coating desired and higher concentrations of the cerium ions produce corresponding increases in the yellow color of the passivate film.

Because of cost considerations, the cerium ions are preferably introduced as a commercially available mixture of rare earth salts of metals in the lanthanide series which contains cerium compounds as the principal component. One such commercially available material is a cerous chloride solution containing about 46% solids of which $CeCl_3\cdot 6H_2O$ predominates. The cerous chloride solution is derived from a rare earth oxide (REO) concentrate sold by Molycorp, Inc. of White Plains, N.Y. under product code 5310 containing a minimum of 99 percent total REO of which $CeO_2$ is 96%, $La_2O_3$ is 2.7%, $Nd_2O_3$ is 1% and $Pr_6O_{11}$ is 0.3%. A ceric sulfate solution is commercially available from the same source containing about 42% solids of which $Ce(SO_4)_2\cdot H_2O$ predominates and which is also prepared from product code 5310 containing other rare earth metal compounds in similar minor amounts.

The concentration of the additional metal ions other than cerium ions for appropriate activation of the treating bath to produce a clear to blue-bright appearance is controlled to provide a concentration ranging from about 0.02 up to about 1 g/l with concentrations of from about 0.1 to about 0.2 g/l being preferred. While such metal ions can be used in concentrations above 1 g/l, such as, up to 10 g/l, the use of such higher concentrations even in the absence of cerium ions tends to produce dull films of a yellow tint rather than the desired clear or light-blue films. For this reason, such higher concentrations are undesirable from an appearance standpoint.

A further essential constituent of the improved bath of the present invention comprises an organic carboxylic acid or salt thereof of the structural formula as hereinbefore set forth present in an amount effective to impart increased clarity and initial hardness to the gelatinous chromate film deposited. The unexpected improvement in clarity of the film is particularly pronounced in connection with the light-yellow iridescent films produced from cerium ion containing solutions. The particular concentration or range of concentrations of the clarity/hardness agent will vary in proportion to molecular weight of the particular acid and/or metal salt employed with higher concentrations required or an equivalent effectiveness as the molecular weight of the additive agent increases. The particular concentration to achieve optimum clarification and hardness is also dictated to some extent by the concentration of the other metal ions present in the bath with higher concentrations being used as the metal ion concentrations increase. Generally, the organic carboxylic acid additive agent or metal salts thereof can be employed in amounts ranging from about 0.05 up to about 4.0 g/l with concentrations of about 0.1 to about 1.0 g/l being usually preferred.

The additive can be introduced as the organic acid itself or as any bath soluble and compatible metal salt including the alkali metal salts, ammonium salts and salts of the several additional metal ions in the bath. For economic reasons, the organic acid is usually introduced as an acid or as the sodium or potassium salt thereof.

Within the scope of the structural formula as hereinabove set forth, organic carboxylic acids which have been found particularly suitable include malonic, maleic, succinic, gluconic, tartaric and citric, of which succinic or succinate salts have been found particularly effective.

As an optional but preferred constituent, the bath contains halide ions including chlorine, bromine and fluorine ions which have been found to enhance the hardness of the passivate film on the treated substrate. The halide ions or mixture thereof can conveniently be introduced employing any of the alkali metal and ammonium salts thereof as well as salts of the metal ions hereinabove set forth. The concentration of the total halide constituent in the bath normally may range up to about 2 grams per liter with concentrations of about 0.1 to about 0.5 g/l being typical.

In addition to the foregoing, the use of a small effective amount of a variety of bath compatible wetting agents also provides beneficial results in the nature of the passivate film deposited. When employed the wetting agent can be present in concentrations up to about 1 gram per liter (g/l) with concentrations of about 50 to about 100 mg/l being preferred. Wetting agents suitable for use in the treating bath include aliphatic fluorocarbon sulfonates available from 3M under the Fluorad brandname, such as, for example, Fluorad FC 98, which is a nonfoaming wetting agent and its use at about 100 mg/l in the working bath improves the color and hardness of the passivate film. A second class of suitable wetting agents is the sulfo derivatives of succinates. An example of this class is Aerosol MA-80 which is a dihexyl ester of sodium sulfosuccinic acid and is commercially available from American Cyanamid Company. A third class of suitable wetting agents is the sulfonates of naphthalene which are linear alkyl naphthalene sulfonates, such as Petro BA, for example, available from Petrochemical Company.

In accordance with the process aspects of the present invention, a treating bath formulation as hereinabove described is applied to a substrate to be treated by spray, immersion, flooding or the like for a period of time sufficient to form the desired passivate film thereon. The treating solution is preferably controlled within a temperature range of about 40° to about 150° F., with about 70° to about 90° F. being preferred. Temperatures above about 90° F. have a tendency to cause a rapid loss of peroxide-type oxidizing agents when used whereas temperatures below about 70° F. reduce the activity of the bath requiring increased contact times to achieve a passivate film on the same thickness or color intensity as can be achieved at the higher temperatures at shorter time intervals. Typically, contact times of about 20 seconds to about 1 minute are satisfactory with contact times of about 30 seconds being usually preferred.

The operating bath can be conveniently prepared by employing a concentrate containing the active constituents with the exception of the oxidizing agent and cerium ions, if used, which is adapted to be diluted with water to form a bath containing the constituents within the desired concentration range. Similarly, replenishment of the bath on a continuous or intermittent basis can be achieved employing a concentrate of the active constituents with the exception of the oxidizing agent and cerium ions, if used, which is added separately to the operating bath. Typically, a bath make-up concentrate can contain from about 10 to about 80 g/l chromium ions, from about 1.0 to about 80 g/l of the organic carboxylic acid and/or salt additive agent, from about 5 to about 50 g/l of at least one additional metal ion of the group consisting of iron, cobalt, nickel, molybdenum, manganese, lanthanum, lanthanide mixture or mixtures thereof, halide ions up to about 50 g/l and a suitable surfactant in an amount up to about 5 g/l if employed. Such a make-up concentrate is adapted to be diluted with about 98 volume percent water to produce an operating bath containing the active constituents within the ranges specified. The oxidizing agent such as hydrogen peroxide, for example, is separately introduced into the bath preferably in a form commercially available containing from about 35 to 40 percent by volume hydrogen peroxide. The cerium ions, when employed, are preferably introduced in the form of an aqueous acid solution of cerous chloride or ceric sulfate having cerium ion concentration of from about 200 to about 320 g/l and about 60 to about 100 g/l, respectively. Such cerium concentrates may be conveniently comprised of the commercially available materials hereinbefore described available from Molycorp, Inc.

In order to further illustrate the present invention, the following examples are provided. It will be understood that the examples are provided for illustrative purposes and are not intended to be limiting of the scope of the invention as herein disclosed and as set forth in the subjoined claims.

EXAMPLE 1

A series of trivalent chromium containing concentrates is prepared suitable for dilution with water to make up an operating bath in further combination with an oxidizing agent and cerium or lanthanum ions as follows:

CONCENTRATE A

| INGREDIENT | CONCENTRATION, g/l |
|---|---|
| $Cr^{+3}$ | 24 |
| $CoSO_4.7H_2O$ | 25 |
| Ferrous ammonium sulfate | 12 |
| Sodium fluoroborate | 15 |
| Succinic acid | 25 |
| Nitric acid (100%) | 60 |

CONCENTRATE B

| INGREDIENT | CONCENTRATION, g/l |
|---|---|
| $Cr^{+3}$ | 24 |
| NaCl | 20 |
| Ferrous ammonium sulfate | 25 |
| Sodium succinate | 55 |
| Nitric acid (100%) | 60 |

CONCENTRATE C

| INGREDIENT | CONCENTRATION, g/l |
|---|---|
| $Cr^{+3}$ | 24 |
| Ferric ammonium sulfate | 50 |
| Sodium succinate | 55 |
| NaCl | 20 |
| Nitric Acid (100%) | 60 |

CONCENTRATE D

| INGREDIENT | CONCENTRATION, g/l |
|---|---|
| $Cr^{+3}$ | 24 |
| Ferric ammonium sulfate | 50 |
| Succinic acid | 25 |
| NaCl | 20 |
| Nitric acid (100%) | 60 |

CONCENTRATE E

| INGREDIENT | CONCENTRATION, g/l |
|---|---|
| $Cr^{+3}$ | 24 |
| Ferric ammonium sulfate | 50 |
| NaCl | 20 |
| Malonic acid | 25 |
| Nitric acid (100%) | 60 |

CONCENTRATE F

| INGREDIENT | CONCENTRATION, g/l |
|---|---|
| $Cr^{+3}$ | 24 |
| $Fe_2(SO_4)_3$ | 30 |
| NaCl | 20 |
| Gluconic acid | 20 |
| Nitric acid (100%) | 60 |

CONCENTRATE G

| INGREDIENT | CONCENTRATION, g/l |
|---|---|
| $Cr^{+3}$ | 24 |
| Ferric ammonium sulfate | 50 |
| NaCl | 20 |
| Maleic acid | 25 |
| Nitric acid (100%) | 60 |

EXAMPLE 2

A cerium ion concentrate is provided containing about 80 g/l ceric ions in the form of ceric sulfate in a dilute sulfuric acid solution. An oxidizing agent concentrate is also provided containing about 35% hydrogen peroxide. A series of operating baths is prepared suitable for forming a yellow passivate film on a substrate each containing 2% by volume of the cerium ion concentrate, 2% by volume of the oxidizing agent concentrate, and 2% by volume of one of the chromium concentrates A through G of Example 1.

Steel test panels are subjected to an alkaline, non-cyanide electroplating step to deposit a zinc plating thereon after which they are thoroughly water rinsed and immersed with agitation in each of the test operating baths for a period of about 30 seconds maintained at a temperature of about 70° F. and having a pH ranging from about 1.5 to about 2.0. At the conclusion of the passivation treatment, the passivated panels are warm water rinsed and air dried. An inspection of the coating on each of the test panels immersed in each of the operating test solutions reveals the formation of a clear hard yellow passivate film.

EXAMPLE 3

A lanthanum ion concentrate is provided containing about 60 g/l lanthanum ions in the form of a solution of lanthanum chloride. An oxidizing agent concentrate is also provided containing about 35% hydrogen peroxide. A series of operating baths is prepared suitable for forming a blue-bright passivate film on a substrate each containing 2% by volume of the lanthanum ion concentrate, 2% by volume of the oxidizing agent concentrate, and 2% by volume of one of the chromium concentrates A through G of Example 1.

Zinc plated test panels as described in Example 2 are immersed under the conditions as described in Example 2 whereafter they are warm water rinsed and air dried. An inspection of the coating on each of the test panels after drying reveals an exceptionally bright, clear, hard bluish colored passivate film.

The yellow passivated panels produced using operating baths containing, respectively, concentrates A, B, and C as hereinabove described were aged at least 24 hours and subjected to neutral salt spray corrosion testing according to ASTM procedure B-117. The following table indicates the corrosion resistance results that were obtained using these formulations:

| Chromium Concentrate | Hours Neutral Salt Spray | |
|---|---|---|
| | 72 | 96 |
| A | Clear with some dark spots. | Clear with some dark Spots. |
| B | Clear with some dark spots. | Clear with some dark spots. |
| C | Clear with some dark spots. | Some dark spots - 1% white spots. |

The above results show that panels treated with operating baths containing concentrates A, B, and C have passed the 96 hour salt spray test. Similar results are obtained with the panels produced using the other concentrates.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic solution for treating receptive metal substrates to impart a chromate passivate film thereon comprising chromium ions substantially all of which are in the trivalent state, hydrogen ions to provide an acidic pH, a bath soluble and compatible organic carboxylic acid present in an amount effective to impart initial hardness and clarity to the passivate film of the structural formula:

$$(OH)_aR(COOH)_b$$

wherein:

a is an integer from 0 to 6;

b is an integer from 1 to 3; and

R is an alkyl, alkenyl, or aryl containing from $C_1$ to $C_6$ carbon atoms;

as well as the bath soluble and compatible salts thereof;

at least one additional metal ion selected from the group consisting of iron, cobalt, nickel, molybdenum, manganese, lanthanum, cerium, lanthanide mixture and mixtures thereof present in an effective amount to impart increased corrosion resistance to the treated substrate.

2. The aqueous solution as defined in claim 1 in which the trivalent chromium ions are present in an amount of about 0.05 g/l up to saturation.

3. The aqueous solution as defined in claim 1 in which the trivalent chromium ions are present in an amount of about 0.2 to about 2 g/l.

4. The aqueous solution as defined in claim 1 in which the trivalent chromium ions are present in an amount of about 0.5 to about 1 g/l.

5. The aqueous solution as defined in claim 1 having a pH of about 1.2 to about 2.5.

6. The aqueous solution as defined in claim 1 having a pH of about 1.5 to about 2.0.

7. The aqueous solution as defined in claim 1 having a pH of about 1.6 to about 1.8.

8. The aqueous solution as defined in claim 1 in which said hydrogen ions are introduced by a mineral acid selected from the group consisting of sulfuric, nitric, hydrochloric and mixtures thereof.

9. The aqueous solution as defined in claim 1 in which said oxidizing agent is present in an amount of about 1 to 20 g/l calculated on a weight equivalent effectiveness basis to hydrogen peroxide.

10. The aqueous solution as defined in claim 1 in which said oxidizing agent is present in an amount of about 3 to about 7 g/l calculated on a weight equivalent effectiveness basis to hydrogen peroxide.

11. The aqueous solution as defined in claim 1 in which said oxidizing agent comprises a peroxide.

12. The aqueous solution as defined in claim 1 in which said oxidizing agent comprises hydrogen peroxide.

13. The aqueous solution as defined in claim 1 in which said one additional metal ion and mixtures thereof is present in an amount up to about 10 g/l.

14. The aqueous solution as defined in claim 1 in which said additional metal ion and mixtures thereof includes cerium ions present in an amount of about 0.5 to about 10 g/l.

15. The aqueous solution as defined in claim 1 in which said one additional metal ion and mixtures thereof includes cerium ions present in an amount of about 1 to about 4 g/l.

16. The aqueous solution as defined in claim 1 in which said one additional metal ion or mixtures thereof is present in an amount of about 0.2 to about 1 g/l.

17. The aqueous solution as defined in claim 1 in which said one additional metal ion or mixtures thereof is present in an amount of about 0.1 to about 0.2 g/l.

18. The aqueous solution as defined in claim 1 in which said one additional metal ion comprises iron.

19. The aqueous solution as defined in claim 1 in which said one additional metal ion comprises cobalt.

20. The aqueous solution as defined in claim 1 in which said one additional metal ion comprises nickel.

21. The aqueous solution as defined in claim 1 in which said one additional metal ion comprises molybdenum.

22. The aqueous solution as defined in claim 1 in which said one additional metal ion comprises manganese.

23. The aqueous solution as defined in claim 1 in which said one additional metal ion comprises lanthanum.

24. The aqueous solution as defined in claim 1 in which said one additional metal ion comprises a lanthanide mixture comprised predominantly of lanthanum compounds.

25. The aqueous solution as defined in claim 1 in which said carboxylic acid and salts thereof is present in an amount of about 0.05 to about 4 g/l.

26. The aqueous solution as defined in claim 1 in which said carboxylic acid and salts thereof is present in an amount of about 0.1 to about 1 g/l.

27. The aqueous solution as defined in claim 1 in which said organic carboxylic acid is selected from the group consisting of malonic, maleic, succinic, gluconic, tartaric, citric and mixtures thereof as well as salts thereof.

28. The aqueous solution as defined in claim 1 in which said carboxylic acid and salts thereof comprises succinic acid.

29. The aqueous solution as defined in claim 1 in which said carboxylic acid and salts thereof comprises malonic acid.

30. The aqueous solution as defined in claim 1 in which said carboxylic acid and salts thereof comprises maleic acid.

31. The aqueous solution as defined in claim 1 in which said carboxylic acid and salts thereof comprises gluconic acid.

32. The aqueous solution as defined in claim 1 in which said carboxylic acid and salts thereof comprises tartaric acid.

33. The aqueous solution as defined in claim 1 in which said carboxylic acid and salts thereof comprises citric acid.

34. The aqueous solution as defined in claim 1 further including halide ions.

35. The aqueous solution as defined in claim 34 in which said halide ions are present in an amount up to about 2 g/l.

36. The aqueous solution as defined in claim 34 in which said halide ions are present in an amount of about 0.1 to about 0.5 g/l.

37. The aqueous solution as defined in claim 1 further containing a surfactant.

38. The aqueous solution as defined in claim 37 in which said surfactant is present in an amount up to about 1 g/l.

39. The aqueous solution as defined in claim 37 in which said surfactant is present in an amount of about 50 to about 100 mg/l.

40. The aqueous solution as defined in claim 1 further containing sulfate ions in an amount up to about 15 g/l.

41. The aqueous solution as defined in claim 1 further containing sulfate ions in an amount of about 0.5 to about 5 g/l.

42. A process for treating a receptive metal substrate to impart a chromate passivate film thereon which comprises the steps of contacting the substrate with a solution at a temperature of about 40° to about 150° F. having a composition of claim 1 or 2 or 3 or 4 or 5 or 6 or 7 or 8 or 9 or 10 or 11 or 12 or 13 or 14 or 15 or 16 or 17 or 18 or 19 or 20 or 21 or 22 or 23 or 24 or 25 or 26 or 27 or 28 or 29 or 30 or 31 or 32 or 33 or 34 or 35 or 36 or 37 or 38 or 39 or 40 or 41 for a period of time sufficient to form a passivate film thereon.

* * * * *